US005560679A

United States Patent [19]

Barnholdt

[11] Patent Number: 5,560,679

[45] Date of Patent: Oct. 1, 1996

[54] BOOSTER SEAT

[76] Inventor: Sheri J. Barnholdt, P.O. Box 509, Frederick, Colo. 80530

[21] Appl. No.: 528,996

[22] Filed: Sep. 15, 1995

[51] Int. Cl.[6] ..... A47C 1/08

[52] U.S. Cl. ..... 297/250.1; 297/423.26; 297/423.28; 297/423.3; 297/423.45

[58] Field of Search ..... 297/250.1, 30, 297/111, 183.3, 188.08, 188.11, 188.21, 188.01, 255, 256, 256.1, 250.11, 423.1, 423.19, 423.2, 423.22, 423.23, 423.26, 423.28, 423.3, 423.39, 423.45

[56] References Cited

U.S. PATENT DOCUMENTS 820,125 5/1906 Pennington ..... 297/250.1 X 2,605,815 8/1952 Zoranovich ..... 297/250.1

FOREIGN PATENT DOCUMENTS 363789 8/1921 Germany ..... 297/250.1

365828 12/1922 Germany ..... 297/250.1

499358 6/1930 Germany ..... 297/250.1

2324011 3/1973 Germany ..... 297/250.1

*Primary Examiner*—Laurie K. Cranmer

[57] ABSTRACT

A seat for supporting a child in a spaced orientation relative to a support surface. The inventive device includes a seat member positionable upon a support surface and having a seat recess directed thereinto. A foot rest is mounted to the seat member for supporting the feet of an individual and can be pivoted into a storage recess within the seat member for storage during periods of non-use of the device.

6 Claims, 3 Drawing Sheets

BOOSTER SEAT

BACKGROUND OF THE INVENTION

1. Field of the Invention

The present invention relates to seating structures and more particularly pertains to a booster seat for supporting a child in a spaced orientation relative to a support surface.

2. Description of the Prior Art

The use of seating structures is known in the prior art. More specifically, seating structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art seating structures include U.S. Pat. Nos. 5,335,968; 4,968,091; 5,332,286; 4,662,678; 4,586,747; and U.S. Design Pat. No. 305,387.

While these devices fulfill their respective, particular objectives and requirements, the aforementioned patents do not disclose a booster seat for supporting a child in a spaced orientation relative to a support surface which includes a seat member positionable upon a support surface and having a seat recess directed thereinto, and a foot rest pivotally mounted to the seat member for supporting the feet of an individual which can be pivoted into a storage recess within the seat member for storage purposes.

In these respects, the booster seat according to the present invention substantially departs from the conventional concepts and designs of the prior art, and in so doing provides an apparatus primarily developed for the purpose of supporting a child in a spaced orientation relative to a support surface.

SUMMARY OF THE INVENTION

In view of the foregoing disadvantages inherent in the known types of seating structures now present in the prior art, the present invention provides a new booster seat construction wherein the same can be utilized for supporting a child in a spaced orientation from a support surface. As such, the general purpose of the present invention, which will be described subsequently in greater detail, is to provide a new booster seat apparatus and method which has many of the advantages of the seating structures mentioned heretofore and many novel features that result in a booster seat which is not anticipated, rendered obvious, suggested, or even implied by any of the prior art seating structures, either alone or in any combination thereof.

To attain this, the present invention generally comprises a seat for supporting a child in a spaced orientation relative to a support surface. The inventive device includes a seat member positionable upon a support surface and having a seat recess directed thereinto. A foot rest is mounted to the seat member for supporting the feet of an individual and can be pivoted into a storage recess within the seat member for storage during periods of non-use of the device.

There has thus been outlined, rather broadly, the more important features of the invention in order that the detailed description thereof that follows may be better understood, and in order that the present contribution to the an may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the an will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new booster seat apparatus and method which has many of the advantages of the seating structures mentioned heretofore and many novel features that result in a booster seat which is not anticipated, rendered obvious, suggested, or even implied by any of the prior art tool guides, either alone or in any combination thereof.

It is another object of the present invention to provide a new booster seat which may be easily and efficiently manufactured and marketed.

It is a further object of the present invention to provide a new booster seat which is of a durable and reliable construction.

An even further object of the present invention is to provide a new booster seat which is susceptible of a low cost of manufacture with regard to both materials and labor, and which accordingly is then susceptible of low prices of sale to the consuming public, thereby making such booster seats economically available to the buying public.

Still yet another object of the present invention is to provide a new booster seat which provides in the apparatuses and methods of the prior art some of the advantages thereof, while simultaneously overcoming some of the disadvantages normally associated therewith.

Still another object of the present invention is to provide a new booster seat for supporting a child in a spaced orientation relative to a support surface.

Yet another object of the present invention is to provide a new booster seat which includes a seat member positionable upon a support surface and having a seat recess directed thereinto, and a foot rest pivotally mounted to the seat member for supporting the feet of an individual which can be pivoted into a storage recess within the seat member for storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
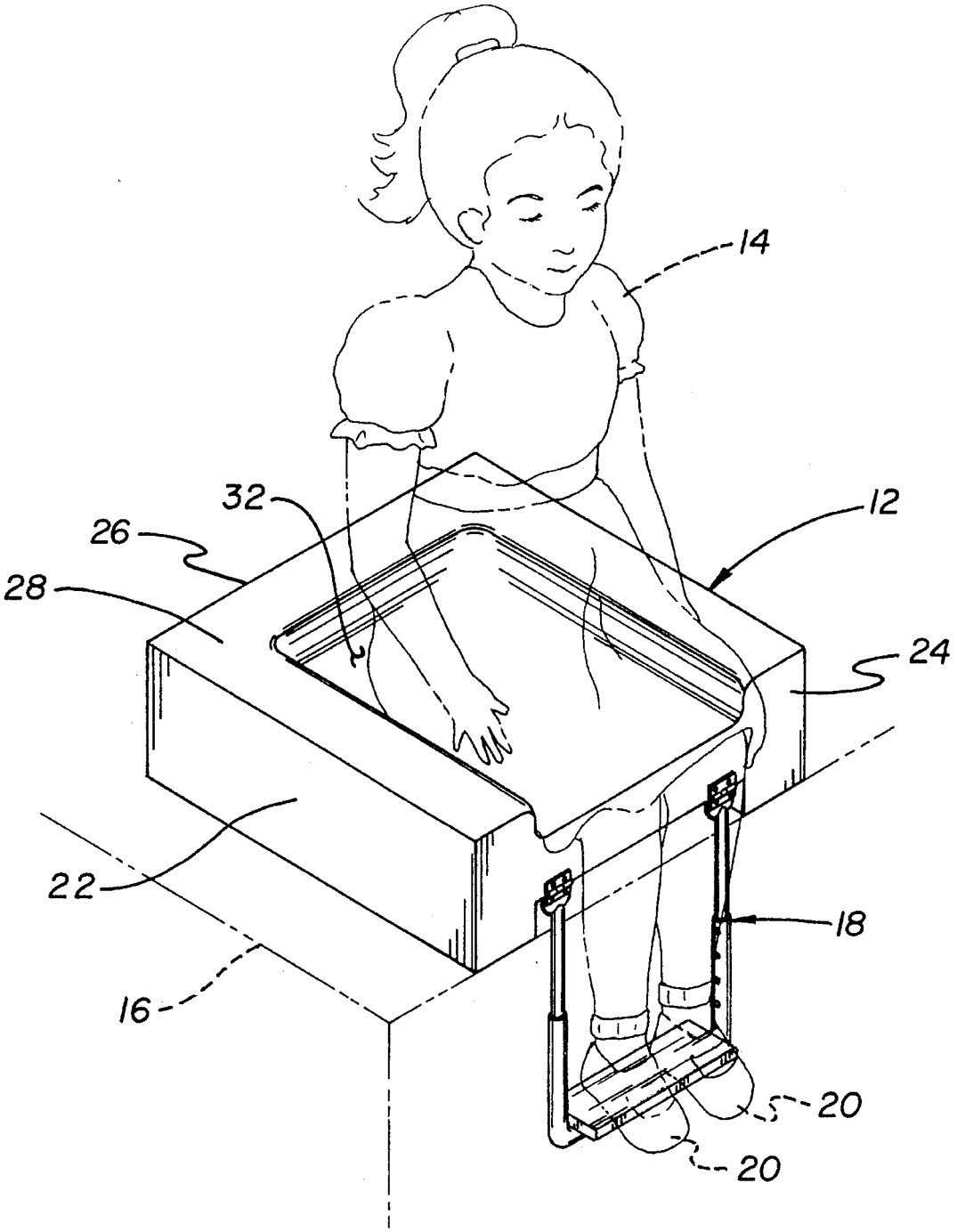
FIG. 1 is an isometric illustration of a booster seat according to the present invention in use.

With reference now to the drawings, and in particular to FIGS. 1–5 thereof, a new booster seat embodying the principles and concepts of the present invention and generally designated by the reference numeral 10 will be described.

More specifically, it will be noted that the booster seat 10 comprises a seat means 12 for supporting an individual such as a child 14 in a spaced orientation relative to a support surface 16 such as is shown in FIG. 1 of the drawings. A foot rest means 18 can be provided with the present invention 10 and projects from the seat means 12 for supporting the feet 20 of the individual 14 relative to the support surface 16 upon which the seat means 12 is positioned. By this structure, an individual such as a child 14 is supported in a comfortable and spaced orientation relative to the support surface 16.

Figure 2:
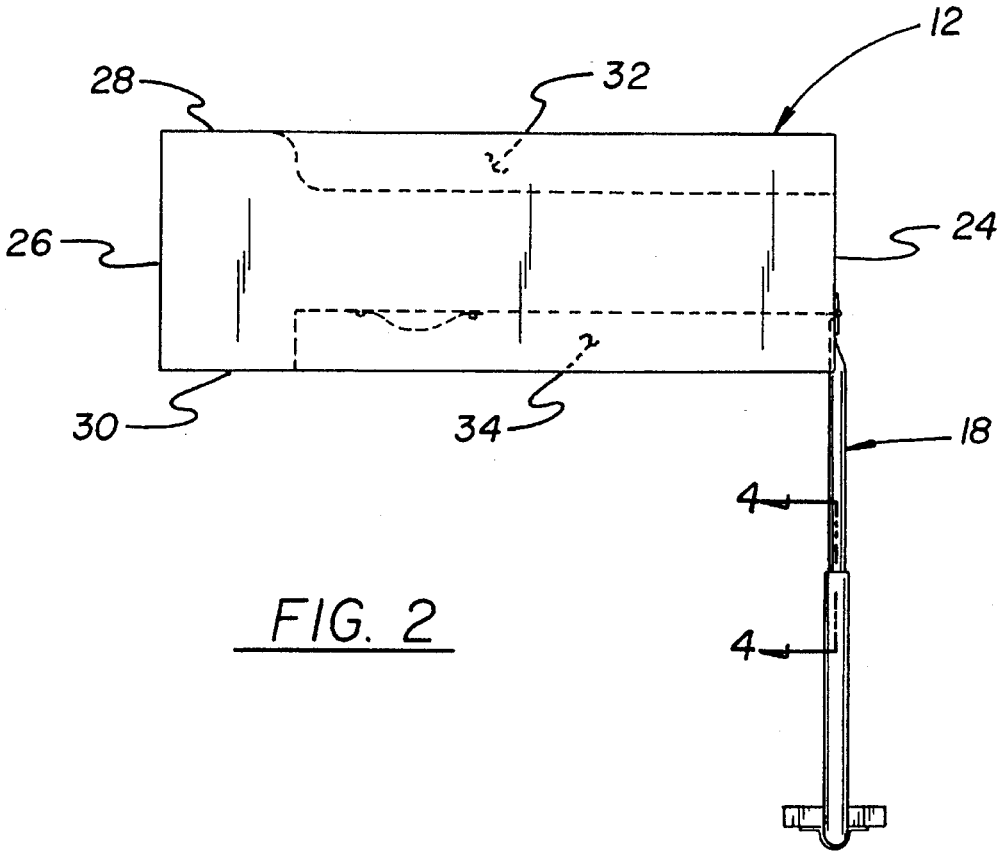
FIG. 2 is a side elevation view of the present invention, per se.
Figure 3:
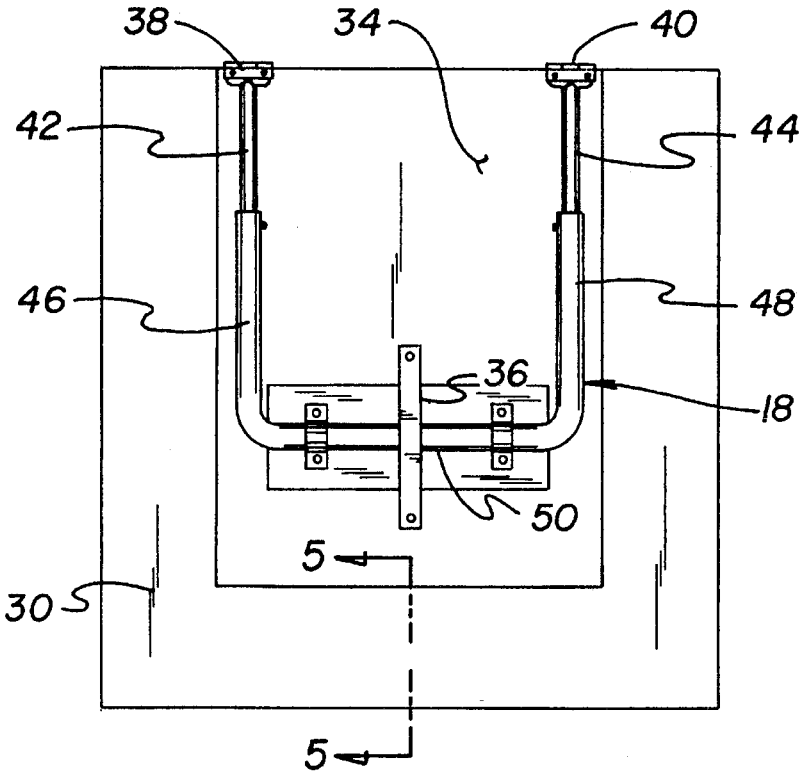
FIG. 3 is a bottom plan view thereof.

Referring now to FIGS. 1 through 3 wherein the present invention 10 is illustrated in detail, it can be shown that the seat means 12 of the present invention 10 preferably comprises a seat member 22 having a front wall 24 spaced from a rear wall 26. The seat member 22 further includes a top wall 28 spaced from a bottom wall 30 as shown in FIG. 2 of the drawings. The seat member 22 is shaped so as to define a seating recess 32 directed into the top wall 28 and extending from contiguous communication with the front wall 24 towards the rear wall 26. Preferably, the seating recess 32 terminates in a spaced orientation relative to the rear wall 26, thereby defining a substantially U-shaped configuration of the top wall 28 as shown in FIG. 1 of the drawings. By this structure, the seat member 22 can be positioned upon a support surface 16, whereby an individual such as the child 14 illustrated in FIG. 1 can be positioned within the seating recess 32 for support relative to the support surface 16.

With continuing reference to FIGS. 1 through 3, it can be shown that the seat member 22 is further shaped so as to define a storage recess 34 directed into the bottom wall 30 of the seat member 22 and extending from contiguous communication with the front wall 24 towards the rear wall 26 of the seat member. The foot rest means 18 is preferably pivotally mounted to the front wall 24 so as to be pivotable into the storage recess 34 as shown in FIG. 3 of the drawings. A releasable securing strap 36 secured to the seat member 22 within the storage recess 34 thereof can be removably coupled about the foot rest means 18 so as to retain the same in the storage position illustrated in FIG. 3 of the drawings.

Figure 4:
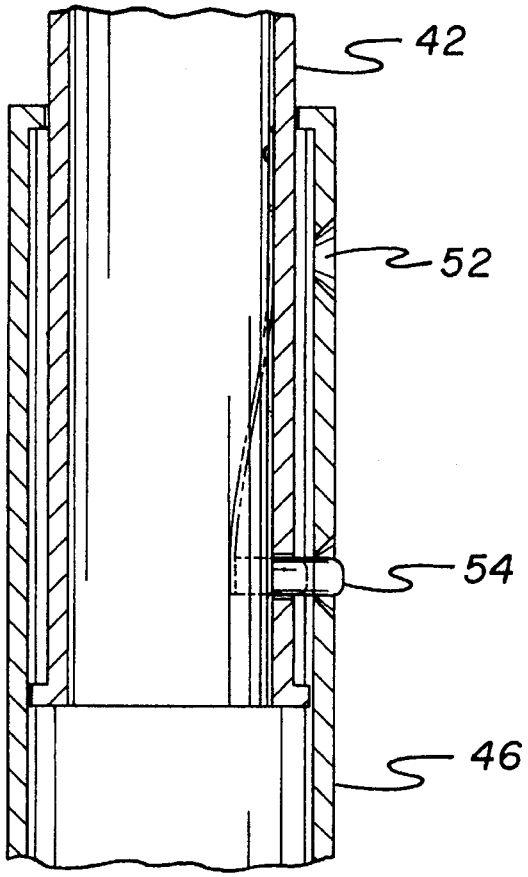
FIG. 4 is a cross-sectional view taken along line 4—4 of FIG. 2.

Referring now to FIGS. 2 through 4, it can be shown that the foot rest means 18 of the present invention 10 preferably comprises a first hinge 38 and a second hinge 40 secured in a spaced orientation to the front wall 24 of the seat member 22 proximal to the storage recess 34. A first mounting member 42 is coupled to the first hinge 38 and extends downwardly therefrom. A second mounting member 44 is similarly coupled to the second hinge 40 and extends downwardly therefrom. The mounting members 42 and 44 can be pivoted into the storage recess 34 as shown in FIG. 3 during storage of the foot rest means 18. The foot rest means 18 further comprises a first telescoping tube 46 telescopingly mounted relative to the first mounting member 42, and a second telescoping tube 48 similarly telescopingly mounted relative to the second mounting member 44. A foot rest member 50 extends substantially orthogonally between the telescoping tubes 46 and 48 so as to complete a definition of the foot rest means 18. As shown in FIG. 4, the telescoping tubes 46 and 48 are each precluded from sliding separation from the respective mounting members 42 and 44 by unlabelled annular projections extending from the ends of the telescoping tubes and mounting members. Further, the foot rest means 18 of the present invention 10 can be additionally configured so as to include adjustment apertures 52 directed through the telescoping tubes 46 and 48 which cooperate with a spring loaded detente projection 54 extending from each of the respective mounting members 42 and 44, whereby the spring loaded detente projection 54 can be projected through one of the adjustment apertures 52 so as to secure a longitudinal orientation of the respective telescoping tubes 46 or 48 relative to the mounting member 42 or 44.

Figure 5:
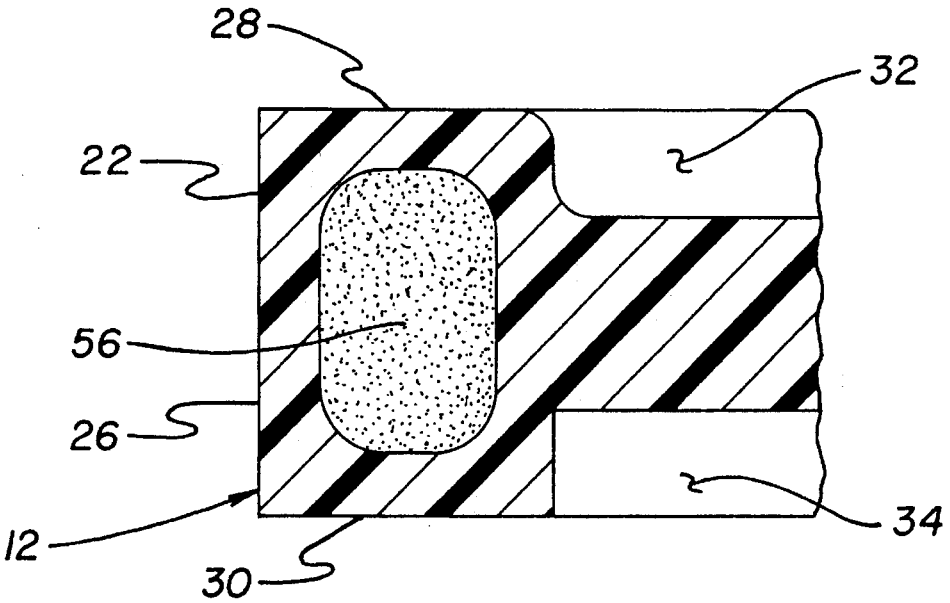
FIG. 5 is a cross-sectional view taken along line 5—5 of FIG. 3.

Referring now to FIG. 5, it can be shown that the seat member 22 of the seat means 12 may further include a weight 56 integrally molded or otherwise positioned therein which serves to preclude an unintentional tipping of the seat member 22 relative to a support surface 16 when the device is in use as shown in FIG. 1 of the drawings. To this end, the weight 56 preferably comprises a metallic material such as lead or the like which is positioned within the seat member 22 and oriented proximal to the rear wall 26 thereof. Preferably, the weight 56 extends transversely across an interior of the seat member 22 and is oriented so as to reside between the top wall 28 and the bottom wall 30 as well as between the recesses 32 and 34 and the rear wall 26. By this structure, the additional gravitational force exerted by the weight 56 will serve to preclude or reduce unintentional tipping of the seat member 22 relative to the support surface 16 as a child 14 leans forwardly of the device 10.

In use, the booster seat 10 of the present invention can be easily utilized for supporting a child in a spaced orientation relative to a support surface 16 such as is illustrated in FIG. 1 of the drawings. The folding configuration of the foot rest means 18 permits the device 10 to be easily collapsed for storage and/or transportation purposes as described above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A booster seat comprising:

a seat means for supporting an individual in a spaced orientation relative to a support surface, the seat means comprises a seat member having a front wall spaced from a rear wall, the seat member including a top wall spaced from a bottom wall and being shaped so as to define a seating recess directed into the top wall and extending from contiguous communication with the front wall towards the rear wall, the seating recess terminating in a spaced orientation relative to the rear wall so as to define a substantially U-shaped configuration of the top wall, the seat member being shaped so as to define a storage recess directed into the bottom wall of the seat member and extending from contiguous communication with the front wall towards the rear wall of the seat member;

a foot reset means projecting from the seat means for supporting feet of the individual relative to the seat means, the foot rest means being pivotally mounted to the front wall so as to be pivotable into the storage recess;

a releasable securing strap secured to the seat member within the storage recess thereof which can be removably coupled about the foot rest means so as to retain the foot rest means in the storage recess.

2. The booster seat of claim 1, wherein the foot rest means comprises a first hinge and a second hinge secured in a spaced orientation to the front wall of the seat member proximal to the storage recess; a first mounting member coupled to the first hinge and extending downwardly therefrom; a second mounting member coupled to the second hinge and extending downwardly therefrom; a first telescoping tube telescopingly mounted relative to the first mounting member; a second telescoping tube telescopingly mounted relative to the second mounting member; and a foot rest member extending between the telescoping tubes.

3. The booster seat of claim 2, wherein at least one of the telescoping tubes is shaped so as to define adjustment apertures directed therethrough; and further comprising a spring loaded detente projection extending from at least one of the mounting members, whereby the spring loaded detente projection projects through one of the adjustment apertures to secure a longitudinal orientation of the telescoping tube relative to the respective mounting member.

4. The booster seat of claim 3, wherein the seat member of the seat means include a weight positioned therein which serves to prevent an unintentional tipping of the seat member relative to a support surface.

5. The booster seat of claim 4, wherein the weight is positioned within the seat member and oriented proximal to the rear wall thereof.

6. The booster seat of claim 5, wherein the weight extends transversely across an interior of the seat member and is oriented so as to reside between the top wall and the bottom wall and between the recesses and the rear wall.

* * * * *